US006992589B2

(12) United States Patent
Marsh

(10) Patent No.: US 6,992,589 B2
(45) Date of Patent: Jan. 31, 2006

(54) SYSTEM AND METHOD FOR EMPLOYEE NOTIFICATION AND EVIDENCE GATHERING DURING A ROBBERY

(76) Inventor: Rebecca M. Marsh, 4165 S. 620 East, Salt Lake City, UT (US) 84107

( * ) Notice: Subject to any disclaimer, the term of this patent is extended or adjusted under 35 U.S.C. 154(b) by 207 days.

(21) Appl. No.: 10/348,589

(22) Filed: Jan. 21, 2003

(65) Prior Publication Data

US 2004/0140901 A1 Jul. 22, 2004

(51) Int. Cl.
*G08B 13/00* (2006.01)

(52) U.S. Cl. ..... 340/574; 340/506; 340/573.1

(58) Field of Classification Search ..... 340/574, 340/506, 573.1, 523, 541, 521, 522
See application file for complete search history.

(56) References Cited

U.S. PATENT DOCUMENTS 4,461,221 A * 7/1984 Schandle et al. ..... 109/6
4,630,110 A * 12/1986 Cotton et al. ..... 348/153
4,818,974 A * 4/1989 Fernandez ..... 340/574
5,412,708 A * 5/1995 Katz ..... 348/14.05
5,517,429 A * 5/1996 Harrison ..... 342/378
6,091,771 A * 7/2000 Seeley et al. ..... 375/240
6,097,429 A * 8/2000 Seeley et al. ..... 348/154

* cited by examiner

*Primary Examiner*—Anh V. La
(74) *Attorney, Agent, or Firm*—Kory D. Christensen; Stoel Rives LLP

(57) ABSTRACT

A security monitor receives an indication of a robbery from a security system. In response, an alert generator sends an alert to a plurality of employee terminals, where the alert causes each of the employee terminals to preemptively display a notification of the robbery and prompt for and record an employee's observations.

61 Claims, 6 Drawing Sheets

SYSTEM AND METHOD FOR EMPLOYEE NOTIFICATION AND EVIDENCE GATHERING DURING A ROBBERY

FIELD OF THE INVENTION

The present invention relates generally to security systems. More specifically, the present invention relates to security systems within banks or other financial institutions.

DESCRIPTION OF RELATED BACKGROUND ART

According to FBI statistics, bank robberies have increased thirty percent over the past two years—from 6,564 in 1999 to 8,494 in 2001—despite the fact that crime statistics in most other categories have dropped during the same period. The Los Angeles area, alone, has witnessed over 11,000 bank robberies in the last ten years. One possible explanation for the rise is that bank robbery is comparatively profitable, with an average loss of $4,552 per bank, as opposed to $620 for a convenience store.

Despite the dramatic portrayal of bank robberies in the media, the goal of most bank robbers is to avoid attention. Typically, a robber claims to be concealing a weapon in a bag or purse and demands money from a single bank employee, such as a teller or cashier. Hence, other employees do not even realize that the bank has been robbed until after the perpetrator has fled the scene.

Unfortunately, this means that most bank employees cannot provide helpful descriptions of the perpetrator to law enforcement. Even the teller who was robbed will often have difficulty remembering specific details, e.g., height, build, hair color, distinguishing marks, etc., due to the stress of the encounter.

Ironically, even if the teller trips a silent alarm, the police may never be summoned. In common practice, a security monitoring company will first place a telephone call to the bank and ask whether a robbery is in progress. If no one other than the teller is aware of the robbery, other bank employees will often assume that it was a false alarm and respond in the negative. Thus, many bank robbers are completely successful in their attempts, and may continue to rob other banks in an area with little fear of being caught.

BRIEF DESCRIPTION OF THE DRAWINGS

Non-exhaustive embodiments of the invention are described with reference to the figures, in which.

DETAILED DESCRIPTION

Figure 1:
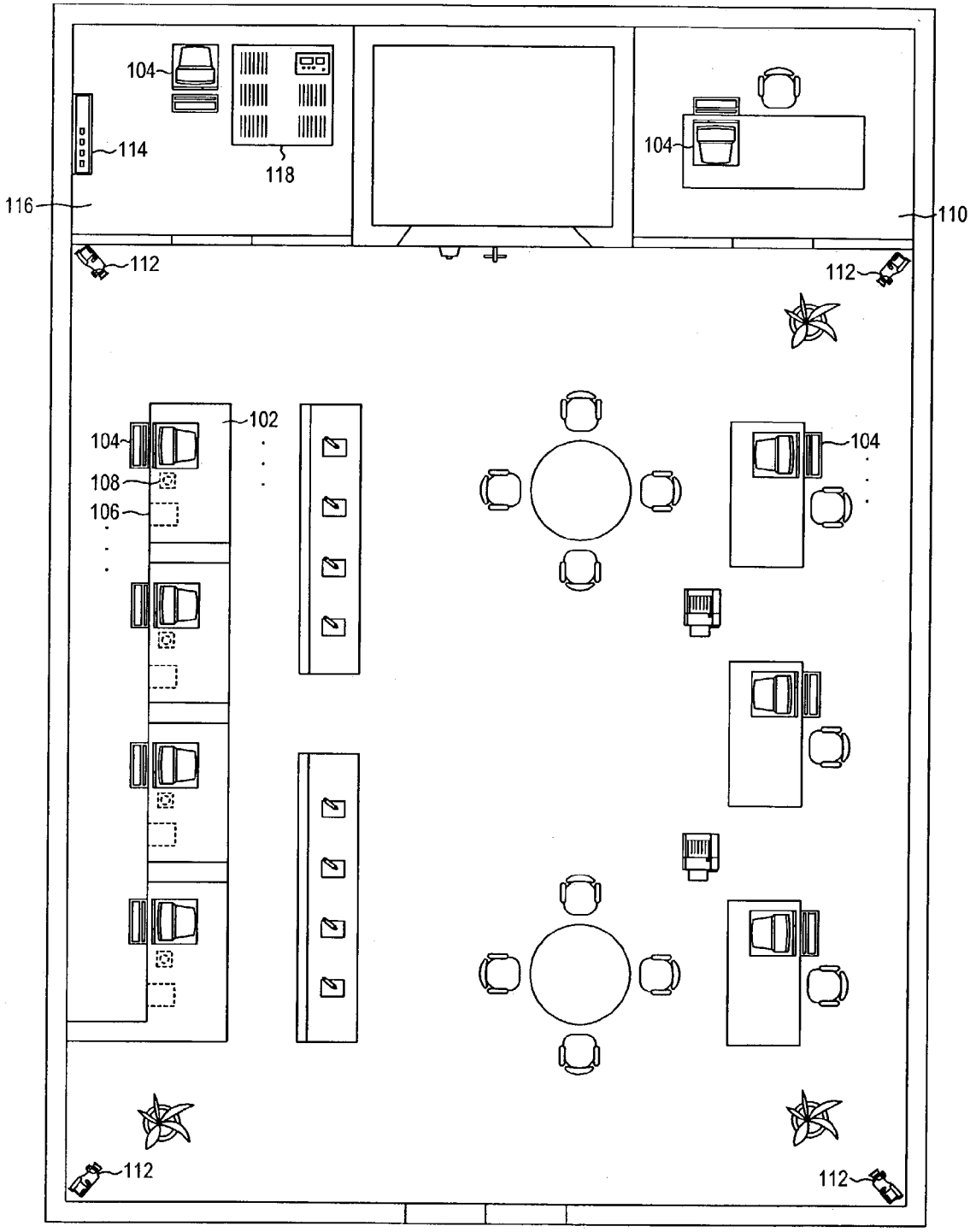
FIG. 1 is a floor plan of a bank or other financial institution.

Reference is now made to the figures in which like reference numerals refer to like elements. For clarity, the first digit of a reference numeral indicates the figure number in which the corresponding element is first used.

In the following description, numerous specific details of programming, software modules, user selections, network transactions, database queries, database structures, etc., are provided for a thorough understanding of the embodiments of the invention. However, those skilled in the art will recognize that the invention can be practiced without one or more of the specific details, or with other methods, components, materials, etc.

In some cases, well-known structures, materials, or operations are not shown or described in detail in order to avoid obscuring aspects of the invention. Furthermore, the described features, structures, or characteristics may be combined in any suitable manner in one or more embodiments.

FIG. 1 is a floor plan of a bank or other financial institution, although the principles disclosed herein could be applied to different enterprises, such as casinos. As illustrated, a bank will typically have a number of teller stations 102, each of which may include a computer terminal 104, a cash drawer 106, and a silent alarm actuator 108.

A typical cash drawer 106 will store $2,000. However, tellers generally have access to as much as $10,000 from a small safe (not shown) in their immediate vicinity. Depending on the level of deposits, the time of day, etc., the amount of cash available to a teller could exceed $20,000.

Tellers are trained to use the actuator 108 to trip the bank's silent alarm when confronted by a robber. The silent alarm actuator 108 may be embodied as a button or switch, as shown, but may also be implemented as a clip or other mechanism within the cash drawer 106 that is activated by the removal of cash from a pre-determined location (e.g., bin).

Computer terminals 104 are also provided for other bank employees, such as loan officers, banker assistants, mortgage consultants, commercial lenders, accountants, branch managers, and the like. Certain employees, such as branch managers, may have separate offices 110 adjacent to the bank lobby.

All banks and other financial institutions have electronic security systems, which typically include a number of closed-circuit television (CCTV) cameras 112, silent alarm actuators 108, etc., all of which are coupled to a security control box 114. The security control box 114 is often located in a secure room 116 that may also house a computer server 118 for the bank and/or other critical electronic equipment.

As previously noted, the number of bank robberies has increased in recent years. However, with all of the potential witnesses in a bank, e.g., tellers, loan officers, branch managers, patrons, etc., it should be relatively easy to assist law enforcement agencies in identifying and prosecuting bank robbers. Nevertheless, for the reasons discussed above, neither the particular teller being robbed nor other employees of a bank are able to provide helpful descriptions of the perpetrator. The teller may be too stressed by the robbery to remember accurate details, while other employees and bank patrons may not even be aware that a robbery is taking place.

Figure 2:
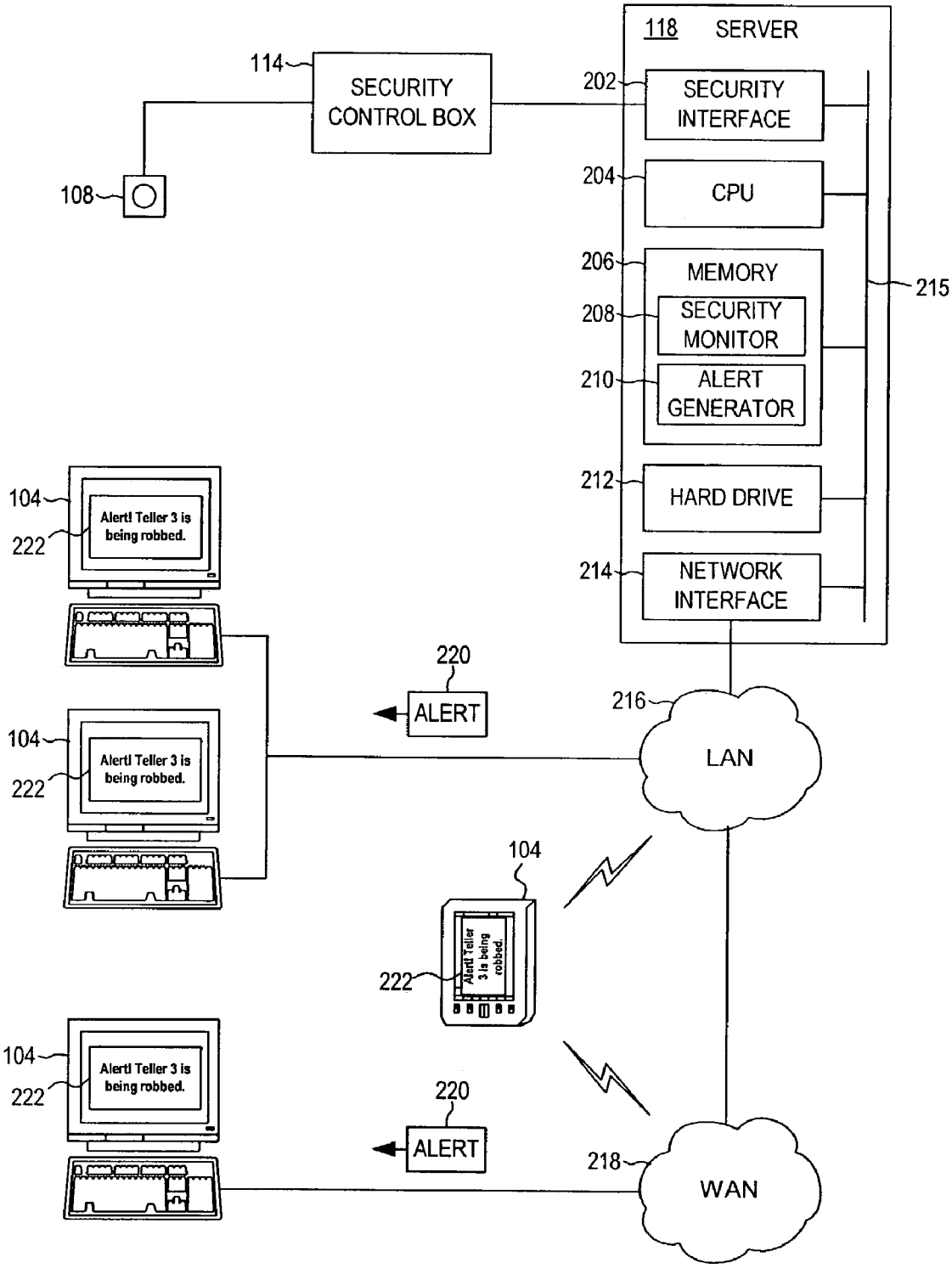
FIG. 2 is a schematic block diagram of a system for employee notification and evidence gathering during a robbery.

FIG. 2 is a schematic block diagram of a system 200 for employee notification and evidence gathering during a robbery. As shown, a security control box 114 is electrically coupled to a silent alarm actuator 108, which may be located at or near a teller station 102 shown in FIG. 1. The security control box 114 may be embodied as any of a number of standard control boxes 114 available from the ADEMCO Group of Syosset, N.Y., although equipment from other security system manufacturers may be used.

In one embodiment, the security control box 114 is directly or indirectly coupled to a computer server 118, which may be the bank's primary server or a computer specifically designated for security operations. As noted, such servers 118 are typically housed in a secure room 116 protected by various types of physical and electronic security. The server 118 may be embodied as any of a number of commercially-available computer servers.

In the depicted embodiment, the server 118 includes a security interface 202 for providing a communication link to the security control box 114. The security interface 202 may conform to various standard interfaces, e.g., RS-232, IEEE-448, IEEE-1394, Universal Serial Bus (USB), Ethernet, etc., based on the capabilities of the particular control box 114.

As shown, the server 118 also includes a Central Processing Unit (CPU) 204, such as an Intel™ x86 processor, for executing program instructions stored in a memory 206. The memory 206 may include various combinations of Random Access Memory (RAM) and Read Only Memory (ROM). As described in greater detail below, the memory 206 may store various software modules, such as a security monitor 208 and an alert generator 210. In various embodiments, these modules may be implemented using hardware or combinations of hardware and software.

The server 118 also includes a hard drive 212 for storing software modules and data, as well as an operating system (OS) for the server 118, such as Windows NT Server™ or Linux™. The hard drive 212 may or may not be used to store the bank's financial information.

In addition, the server 118 includes a network interface 214 for communicating with a number of employee terminals 104 through a Local Area Network (LAN) 216. The network interface 214 may be embodied, for instance, as a standard Ethernet adapter, although other network interfaces 214 are contemplated. All of the above-described components of the server 118, including the network interface 214, may be interconnected via a bus 215.

In certain configurations, the LAN 216 may be coupled to a Wide Area Network (WAN) 218 for communicating with terminals 104 at remote branches or locations. As illustrated, certain employee terminals 104 may be embodied as wireless devices, such as Personal Digital Assistants (PDAs), which may be likewise accessible via the LAN 216 or WAN 218.

In operation, a teller, cashier, or other employee uses the silent alarm actuator 108 to trip the silent alarm during a robbery. In one embodiment, the security control box 114 notes which teller tripped the silent alarm based on the location (e.g., teller station 102) of the actuator 108.

In one configuration, the security monitor 208 within the server 118 continuously monitors the security control box 114 for an indication of a robbery. When an indication is received, the alert generator 210 generates and sends an alert 220 to each of the employee terminals 104 connected to the LAN 216.

An alert 220 may be implemented in various ways, all of which are considered to be within the scope of the invention. For instance, an alert 220 may be embodied as a special User Datagram Protocol (UDP) packet in one embodiment. In other implementations, an alert 220 may be embodied as an e-mail message, Internet Protocol (IP) packet, or other type of notification received via the LAN 216. The precise format of the alert 220 is not relevant. Furthermore, different types of alerts 220 may be sent to different employee terminals 104 in one embodiment.

As described in greater detail below, when an alert 220 is received, an employee terminal 104 displays a notification 222 of the robbery to the employee. The notification 222 may be displayed in various contexts, such as a pop-up window or a ticker.

In one embodiment, the notification 222 preempts (e.g., takes the place of, displaces, interrupts) what is currently being displayed by the computer terminal 104. For example, if an employee is currently editing a document in a word processor, the notification 222 may obscure a portion of the document. This is in contrast, for example, to the employee receiving an e-mail message through a standard e-mail client, such as Microsoft Outlook™. In that case, the user would be notified of an incoming e-mail message and still need to use the client to read the message. Employees often do not read e-mail messages as they are received.

The notification 222 may indicate which teller is being robbed. This allows an employee receiving the notification 222 to carefully observe the individual currently with that teller, increasing the likelihood of obtaining helpful descriptions. In addition, knowing which teller is being robbed may help other employees from becoming inadvertently entangled in the robbery, risking death or serious injury.

In one embodiment, an employee is prevented from removing the notification 222 until after the robbery is over. The notification 222 may be automatically removed by the employee terminal 104 in response to an "all clear" message (not shown) received from the server 118.

Figure 3:
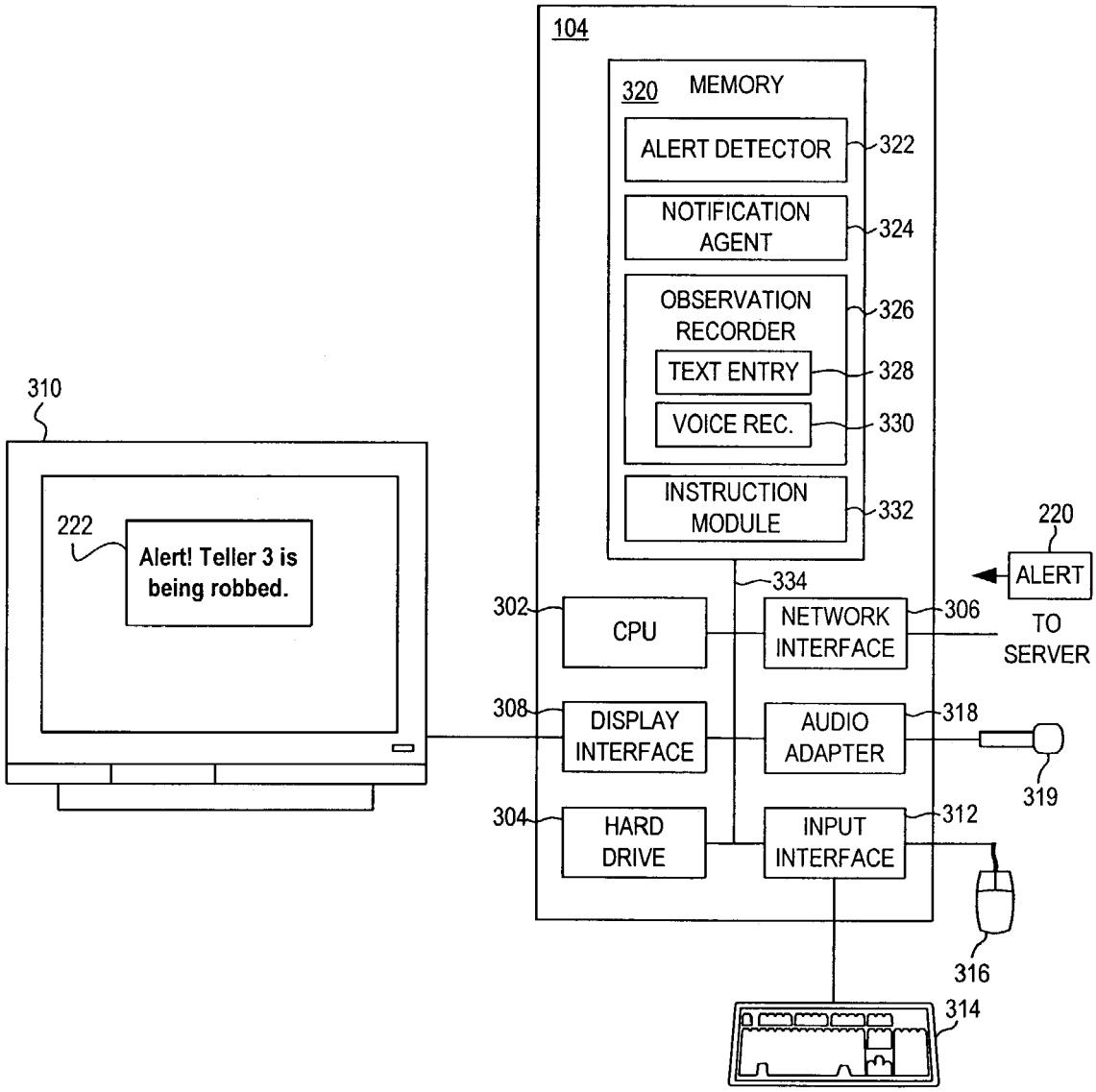
FIG. 3 is a schematic block diagram of an employee computer terminal.

FIG. 3 is a more detailed schematic block diagram of an employee terminal 104, which may be embodied as a standard PC-compatible computer. As illustrated, the employee terminal 104 includes a CPU 302, hard drive 304, and network interface 306, similar to the components found in the server 118.

In addition, the employee terminal 104 includes a display interface 308 for displaying text and graphics, including the notification 222, on a monitor 310. Likewise, the employee terminal 104 includes an input interface 312 for receiving user input from a keyboard 314 and/or mouse 316.

In certain configurations, the employee terminal 104 may include an audio adapter 318 capable of receiving and recording an employees voice via a microphone 319. The microphone 319 may be integrated with or attached to the computer terminal 104 or monitor 310.

The employee terminal 104 also includes a memory 320 for storing program code and data. The memory 320 may store, in one embodiment, a number of software modules, including an alert detector 322, a notification agent 324, an observation recorder 326 (which may include or be associated with a text entry module 328 and voice recording module 330), and an instruction module 332. As before, any of the above-identified modules may be implemented in hardware. Also, as in the case of the server 118, each of the above-identified components may be interconnected via a bus 334.

Figure 4:
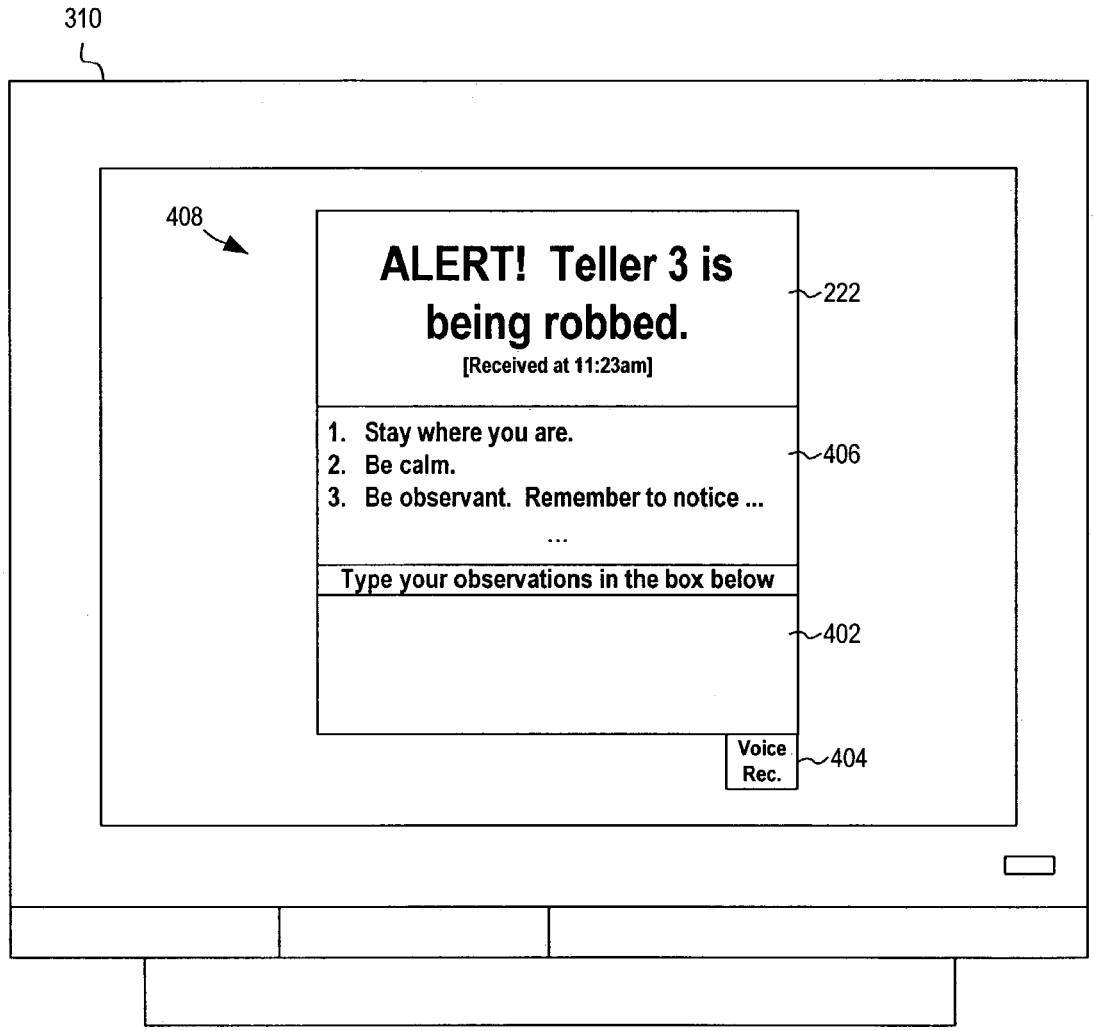
FIG. 4 is a schematic illustration of a user interface for notifying an employee of a robbery and receiving employee observations.

In operation, the alert detector 322 senses the receipt of an alert 220 (e.g., UDP packet, e-mail message, etc.) from the server 118. Thereafter, the alert detector 322 signals the notification agent 324 to preemptively display the notification 222 on the monitor 310. As shown in FIG. 4, the notification 222 may include an indication of the particular employee being robbed (which may be included with the alert 220) as well as the time at which the notification 222 was displayed.

In one embodiment, the observation recorder 326 prompts an employee to enter one or more contemporaneous observations during the robbery, e.g., descriptions of the robber, accomplices, getaway vehicle, etc. Human memory loses many details within a few minutes. Moreover, stressful situations can interfere with recall. Hence, it is desirable to provide a mechanism for immediately recording any such observations for later use in identifying and prosecuting the perpetrator(s).

As illustrated in FIG. 4, a text entry module 328 associated with the observation recorder 326 may display a text entry box 402 in which an employee may type his or her observations. The text entry box 402 may be displayed adjacent to, within, or in close proximity to the notification 222. The observations may be stored within the employee terminal 104 until needed, at which time they can be retrieved as described below in connection with FIG. 5. Automatically providing an employee with a mechanism for entering observations is beneficial in that an employee need not fumble for a pencil and paper, remember to open a word processing window, etc.

Alternatively, or in addition, a voice recording module 330 associated with the observation recorder 326 may display a voice recording control 404 on the monitor 310. When activated, the voice recording control 404 causes the audio adapter 318 to begin recording the employees voice via the microphone 319. Such a control 404 may be more appropriately used by a branch manager or other employee having a separate office 110. In many cases, such offices 110 have glass walls, permitting the branch manager to observe the robber but not be overheard while recording vocal observations.

In certain instances, the voice recording feature can be used to record the voice of the robber. For example, a nearby teller could activate the voice recorder control 404 to record the robber's voice, while typing a physical description of the robber into the text entry box 402.

In one embodiment, the instruction module 332 displays a set of instructions 406 for the receiving employee to carry out during the robbery. The instructions 406 may comprise standard bank policies and procedures for the situation. For example, the employee may be instructed to stay at his or her terminal 104, be calm, and be observant. In addition, the employee may be reminded to notice certain details about the robber, e.g., distinguishing marks or features. The instructions 406 may be received with the alert 220 or may be stored locally within the employee terminal 104.

Since the notification 222 introduces a new dynamic to the robbery—other employees are aware of the robbery—it is important that the employees take no action that would endanger the life of the teller being robbed or otherwise escalate the situation. The instructions 406 provide a mechanism for reinforcing the employees' training in this regard and may save lives.

In certain configurations, the instructions 406 may be specific to the particular employee receiving them. For example, the instructions 406 given to the branch manager may differ from the instructions 406 given to one of the tellers. Where the instructions 406 are received with the alert 220, the alert generator 210 may send the personalized instructions 406 to each employee. Alternatively, different employee terminals 104 may store different sets of instructions 406, depending on the employee.

The notification 222, text box 402, and/or instructions 406 may be displayed together in a notification interface 408 on the monitor 310. As previously mentioned, the display of the notification interface 408 may be preemptive in that it may overwrite a portion of the text and graphics being previously displayed. In one configuration, the notification interface 408 may not be removed (the employee may be prevented from removing the interface 408) during the robbery., In one embodiment, this is done by disabling the "close" button from a window including the notification interface 408 (assuming a Microsoft Windows™ or similar environment). The interface 408 may remain on the monitor 310 for a predetermined time period or until an "all clear" message is received from the server 118, after which it may be removed.

Figure 5:
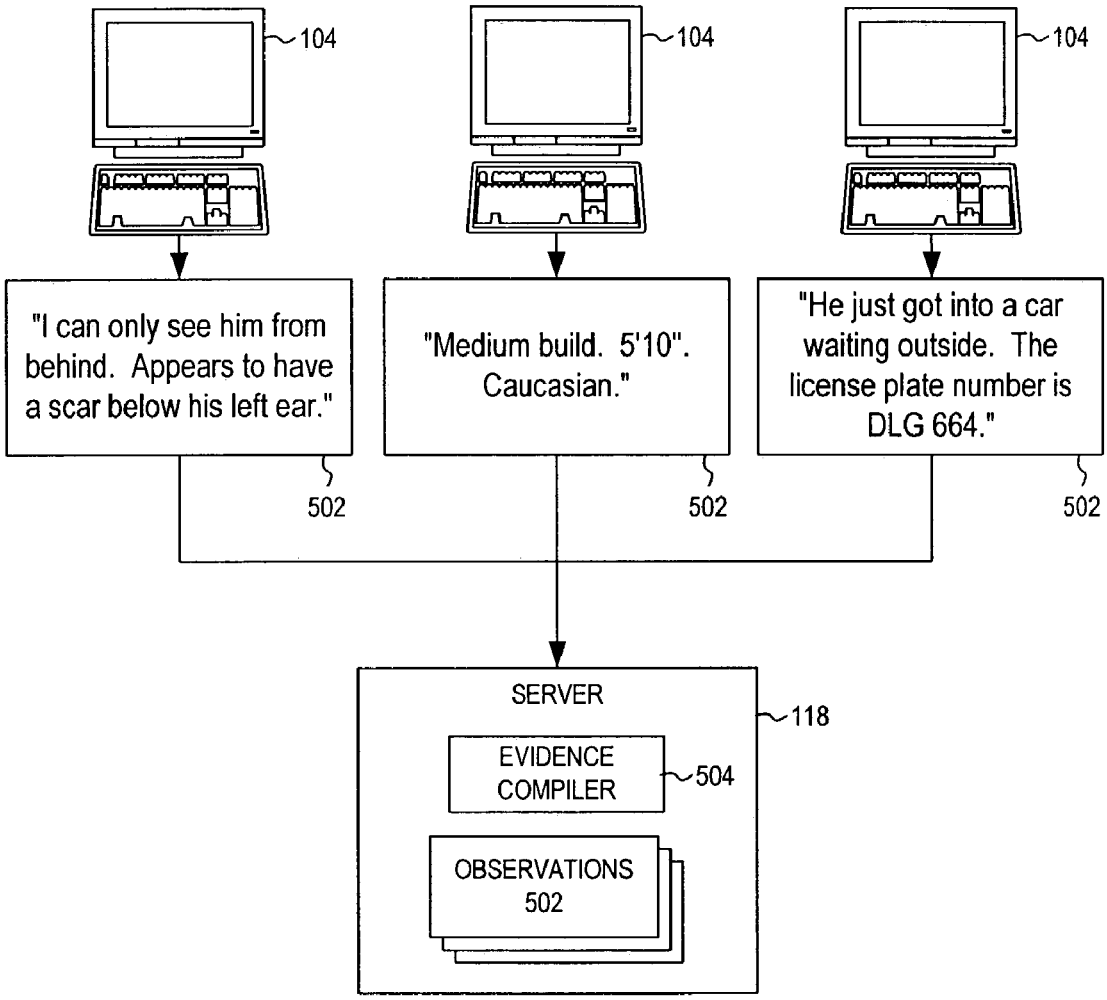
FIG. 5 is a schematic illustration of a process of gathering evidence from several employee terminals.

FIG. 5 is a schematic illustration of a process of gathering evidence after a robbery. As shown, various computer terminals 104 may have recorded employee observations 502. These observations 502 may be sent to or retrieved by an evidence compiler 504 within the server 118 using standard push/pull techniques. The evidence compiler 504 may be embodied as a software module resident within the server's memory 206.

The observations 502 are then stored within the server 118 (e.g., the server's hard drive 212), along with an indication of the employee or employee terminal 104 from which the observations 502 were received. Such observations would be highly valuable to law enforcement agencies since they were obtained contemporaneously with the robbery and may provide detailed descriptions of the robber from many different perspectives or vantage points.

Figure 6:
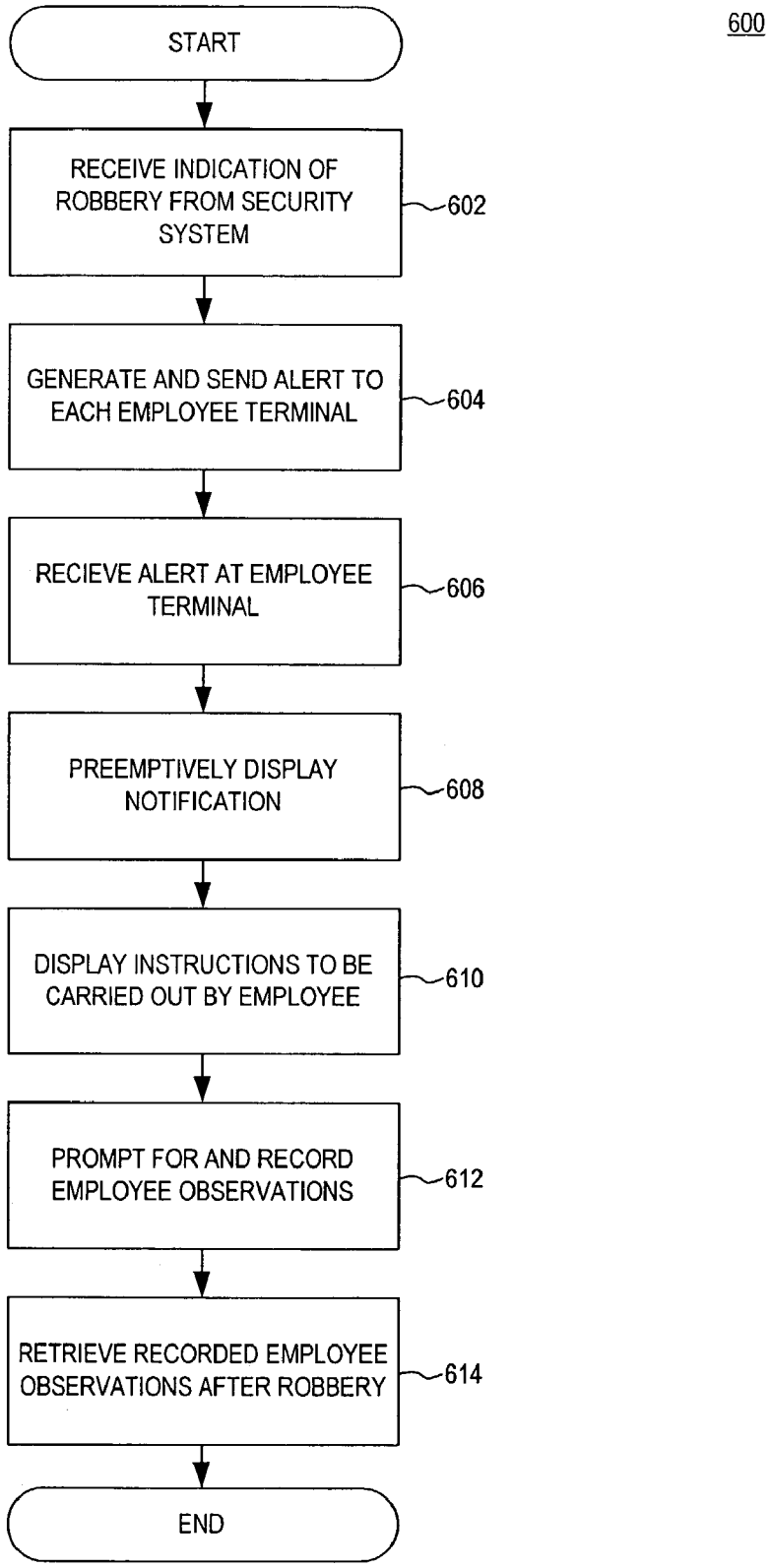
FIG. 6 is a flowchart of a method for employee notification and evidence gathering during a robbery.

FIG. 6 is a flowchart of a method 600 for employee notification and evidence gathering during a robbery. Initially, a security monitor 208 within a server 118 receives 602 an indication of a robbery from a security system control box 114. Thereafter, an alert generator 210 generates and sends 604 an alert 220 to each of a number of employee terminals 104 connected to the server 118 via a LAN 216.

An employee terminal 104 then receives 606 the alert 220, after which a notification agent 324 preemptively displays a notification 222 of the robbery on a computer monitor 310. In certain embodiments, an instruction module 332 displays 610 a set of instructions 406 for the receiving employee to carry out during the robbery. The instructions 406 may or may not be specific to the particular employee.

In one embodiment, an observation recorder 326 prompts for and records 612 any employee observations 502 during the robbery. Written and/or oral observations may be received by the text entry module 328 and/or voice recording modules 330, respectively. After the robbery, the evidence compiler 504 within the server 118 may retrieve 614 any recorded observations 502 from the employee terminals 104 and store the same for use by law enforcement.

While specific embodiments and applications of the present invention have been illustrated and described, it is to be understood that the invention is not limited to the precise configuration and components disclosed herein. Various modifications, changes, and variations apparent to those skilled in the art may be made in the arrangement, operation, and details of the methods and systems of the present invention disclosed herein without departing from the spirit and scope of the invention.

What is claimed is:

1. A system for alerting employees to a robbery comprising:

a security monitor to receive an indication of a robbery from a security system;

an alert generator to send an alert to a plurality of employee computer terminals, wherein the alert is to cause each of the employee computer terminals to preemptively display a notification of the robbery on an associated display screen; and an observation recorder to automatically prompt an employee for the employee's written or spoken observations and record the employee's written or spoken observations during the robbery in response to the alert using the display screen.

2. The system of claim 1, wherein the notification specifies a particular employee who is being robbed.

3. The system of claim 1, wherein the notification specifies an approximate time of the robbery.

4. The system of claim 1, wherein the notification comprises a set of instructions for a receiving employee to carry out during the robbery.

5. The system of claim 4, wherein at least one set of instructions is specific to a particular employee.

6. The system of claim 1, wherein the notification comprises a pop-up window displayed on a screen unrelated to security monitoring.

7. The system of claim 1, wherein the notification comprises a ticker presented on the display screen.

8. The system of claim 1, wherein at least one employee is a teller at a financial institution.

9. The system of claim 1, wherein at least one employee computer terminal comprises:

an alert reception module to receive the alert; and a notification agent to preemptively display the notification message.

10. The system of claim 1, further comprising:

an evidence compiler for retrieving stored employee observations from the plurality of employee computer terminals.

11. A system for alerting employees to a robbery comprising:

a security monitor for receiving an indication of a robbery from a security system; and an alert generator to send an alert to a plurality of employee computer terminals through a network, wherein the alert is to cause each of the employee computer terminals to preemptively display a notification of the robbery on an associated display screen and to cause each of the employee computer terminals to automatically prompt an employee for the employee's observations and record the employee's observations during the robbery.

12. An apparatus for alerting employees to a robbery comprising:

an alert detector to receive an alert indicating that a robbery is in progress;

a notification agent to preemptively display a notification of the robbery on a display screen of an employee's computer terminal; and an observation recorder to automatically prompt the employee for the employee's written or spoken observations and record the employee's written or spoken observations during the robbery in response to the alert using the display screen.

13. The apparatus of claim 12, wherein an observation comprises a text description.

14. The apparatus of claim 12, wherein an observation comprises a vocal description.

15. The apparatus of claim 12, wherein the notification agent is to prevent the notification from being removed from the display screen until after the robbery.

16. The apparatus of claim 12, wherein the notification specifies a particular employee who is being robbed.

17. The apparatus of claim 12, wherein the notification specifies an approximate time of the robbery.

18. The apparatus of claim 12, further comprising:

an instruction module for displaying with the notification a set of instructions on the display screen for a receiving employee to carry out during the robbery.

19. The apparatus of claim 18, wherein the set of instructions is specific to a particular employee.

20. The apparatus of claim 12, wherein the notification comprises a pop-up window displayed on a screen unrelated to security monitoring.

21. The apparatus of claim 12, wherein the notification comprises a ticker presented on the display screen.

22. The apparatus of claim 12, wherein at least one employee is a teller at a financial institution.

23. The apparatus of claim 12, wherein the alert is received through a network.

24. An apparatus for alerting employees to a robbery comprising:

an alert detector to receive an alert that a robbery is in progress;

a notification agent to preemptively display a notification of the robbery on a display screen of an employee's computer terminal; and an instruction module to instruct a receiving employee to carry out a set of instructions during the robbery, the set of instructions also being displayed on the employee's computer terminal.

25. The apparatus of claim 24, wherein the set of instructions is specific to a particular employee.

26. A system for alerting employees to a robbery comprising:

means for receiving an indication of a robbery from a security system; and means for sending an alert to a plurality of employee computer terminals, wherein the alert is to cause each of the employee computer terminals to preemptively display a notification of the robbery and instruct an employee to carry out a set of instructions during the robbery via a respective computer terminal.

27. An apparatus for alerting employees to a robbery comprising:

means for receiving an alert that a robbery is in progress;

means for preemptively displaying a notification of the robbery on a display screen; and means for automatically prompting an employee for the employee's written or spoken observations and recording the employee's written or spoken observations during the robbery in response to the alert using a computer display screen.

28. A computer program product comprising a computer-readable medium including program code for performing a method for alerting employees to a robbery, the method comprising:

receiving an indication of a robbery from a security system; and sending an alert to a plurality of employee computer terminals, wherein the alert is to cause each of the employee computer terminals to preemptively display a notification of the robbery; and automatically prompting an employee for the employee's written or spoken observations and recording the employee's written or spoken observations during the robbery in response to the alert using a computer terminal display screen.

29. A computer program product comprising a computer-readable medium including program code for performing a method for alerting employees to a robbery, the method comprising:

receiving an alert indicating that a robbery is in progress;

preemptively displaying a notification of the robbery on a display screen; and automatically prompting an employee for the employee's written or spoken observations and recording the employee's written or spoken observations during the robbery in response to the alert using a computer display screen.

30. A method for alerting employees to a robbery comprising:

receiving an indication of a robbery from a security system;

sending an alert to a plurality of employee computer terminals, wherein the alert is to cause each of the employee computer terminals to preemptively display a notification of the robbery; and within the employee computer terminal:

prompting an employee, for an observation during the robbery; and recording the observation.

31. The method of claim 30, wherein the notification specifies a particular employee who is being robbed.

32. The method of claim 30, wherein the notification specifies an approximate time of the robbery.

33. The method of claim 30, wherein the notification comprises a set of instructions for a receiving employee to carry out during the robbery.

34. The method of claim 33, wherein at least one set of instructions is specific to a particular employee.

35. The method of claim 30, wherein the notification comprises a pop-up window displayed on a screen unrelated to security monitoring.

36. The method f claim 30, wherein the notification comprises a ticker presented on the computer terminal.

37. The method of claim 30, wherein at least one employee is a teller at a financial institution.

38. The method of claim 30, further comprising:

within an employee computer terminal:

receiving the alert; and preemptively displaying the notification message.

39. The method of claim 30, further comprising:

retrieving observations stored by the plurality of employee computer terminals.

40. A method for alerting employees to a robbery comprising:

receiving an indication of a robbery from a security system; and sending an alert to a plurality of employee computer terminals through a network, wherein the alert is to cause an employee computer terminal to preemptively display a notification of the robbery and to cause the employee computer terminal to automatically prompt an employee for the employee's observations and record the employee's observations during the robbery.

41. A method for alerting employees to a robbery comprising:

receiving an alert indicating that a robbery is in progress;

preemptively displaying a notification of the robbery on a display screen of a employee's computer terminal; and automatically prompting the employee for the employee's observations and recording the employee's observations during the robbery using the computer terminal.

42. The method of claim 41, wherein an observation comprises a text description.

43. The method of claim 41, wherein an observation comprises a vocal description.

44. The method of claim 41, further comprising:

preventing the notification from being removed from the display screen until after the robbery.

45. The method of claim 41, wherein preemptively displaying a notification comprises specifying a particular employee who is being robbed.

46. The method of claim 41, wherein preemptively displaying a notification comprises specifying an approximate time of the robbery.

47. The method of claim 41, further comprising:

displaying with the notification on the computer terminal a set of instructions for a receiving employee to carry out during the robbery.

48. The method of claim 47, wherein the set of instructions is specific to a particular employee.

49. The method of claim 41, wherein preemptively displaying a notification comprises showing the notification as a pop-up window displayed on a screen unrelated to security monitoring.

50. The method of claim 41, wherein preemptively displaying a notification comprises showing the notification as a ticker on the computer terminal.

51. The method of claim 41, wherein at least one employee is a teller at a financial institution.

52. The method of claim 41, wherein receiving comprises receiving an alert through a network.

53. A method for alerting employees to a robbery comprising:

indicating that a robbery is in progress;

preemptively displaying a notification of the robbery on a display screen of an employees computer terminal; and instructing the employee to carry out a set of instructions during the robbery via the computer terminal.

54. The method of claim 54, wherein the set of instructions is specific to a particular employee.

55. A user interface to be displayed on a computer terminal for alerting employees to a robbery, the user interface comprising:

a notification area to be displayed on the computer terminal for notifying an employee about a robbery; and an observation area to be displayed on the computer terminal to prompt for an observation of an employee and provide an interface for receiving the observation of an employee during the robbery.

56. The user interface of claim 55, wherein the notification area specifies a particular employee who is being robbed.

57. The user interface of claim 55, wherein the observation area comprises a text entry area.

58. The user interface of claim 55, wherein the observation area comprises a control for recording a vocal description by the employee.

59. The user interface of claim 55, further comprising:

an instruction area to be displayed on the computer terminal for providing a set of instructions for the employee to carry out during the robbery.

60. The user interface of claim 59, wherein the set of instructions is specific to the particular employee.

61. The user interface of claim 59, wherein the notification area includes an approximate time of the robbery.

* * * * *